United States Patent [19]

Desmarais

[11] 4,014,541

[45] Mar. 29, 1977

[54] GOLF TEE

[75] Inventor: Armand J. Desmarais, New Castle, Del.

[73] Assignee: Hercules Incorporated, Wilmington, Del.

[22] Filed: Apr. 26, 1974

[21] Appl. No.: 464,390

[52] U.S. Cl. ..... 273/33; 71/28; 71/64 F; 273/212

[51] Int. Cl.[2] ..... A63B 57/00; C05C 9/02

[58] Field of Search ..... 71/23, 1, 11, 64 SC, 71/64 A, 64 F, 49, 64 E, 28; 273/33, 212; 260/231 A, 231 R; 264/328

[56] References Cited

UNITED STATES PATENTS

| | | | |
|---|---|---|---|
| 1,645,001 | 11/1927 | Hodges | 71/23 |
| 2,091,993 | 9/1937 | Jones | 71/64 |
| 2,560,414 | 7/1951 | Cheney | 273/33 |
| 3,278,520 | 10/1966 | Klug | 260/231 A |
| 3,290,821 | 12/1966 | Parry | 71/64 A X |
| 3,647,416 | 3/1972 | Messman | 71/64 A X |
| 3,852,421 | 12/1974 | Koyanagi et al. | 260/231 R |

FOREIGN PATENTS OR APPLICATIONS

| | | | |
|---|---|---|---|
| 525,115 | 8/1940 | United Kingdom | 273/33 |

*Primary Examiner*—Frank A. Spear, Jr.
*Assistant Examiner*—Ferris H. Lander
*Attorney, Agent, or Firm*—George H. Hopkins; Stanley A. Becker; Joshua W. Martin, III

[57] ABSTRACT

This invention relates to a golf tee composed of water-soluble thermoplastic material and dispersed therein from about 1 to about 30% by weight, based on the weight of the golf tee, of a fertilizer and to a method of producing said golf tee by injection molding.

5 Claims, 2 Drawing Figures

GOLF TEE

Figure 1:
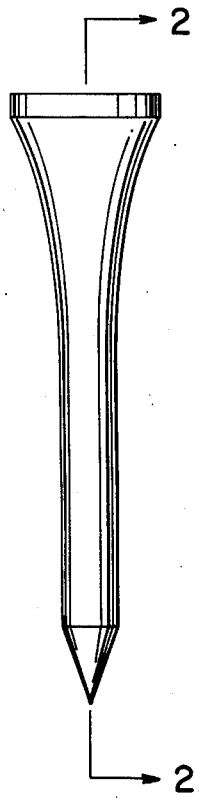

This invention relates to golf tees. More particularly it relates to water-soluble golf tees containing a fertilizer.

A familiar sight to any golfer are the numerous broken and discarded tees scattered in the grass on and surrounding the tee areas of the golf course. Golf tees are usually made of wood or plastic, usually nylon or polystyrene, and remain an eye sore around the tee areas unless physically removed. Plastic golf tees made of nylon or polystyrene are particuarly bothersome as they damage the blades of mowing equipment used to cut the grass. For this reason, some golf courses have now banned the use of plastic tees.

This invention provides a plastic golf tee which has the rigidity and impact resistance required, does not damage mower blades and when exposed to moisture, such as rain, dew, sprinklers, etc., gradually dissolves and releases fertilizer for the grass of the golf course.

In summary, this invention comprises a golf tee composed of water-soluble thermoplastic material and dispersed therein 1–30% by weight, based on the weight of the golf tee of a fertilizer.

Any water-soluble thermoplastic material can be used to prepare the golf tee of this invention. However, it is preferred to use water-soluble thermoplastic hydroxypropyl cellulose having an M.S. of 2 to 10. The term "M.S." as used herein means the average number of moles of reactant (propylene oxide) combined with the cellulose per anhydroglucose unit. This material is commercially available as Klucel hydroxypropyl cellulose. Klucel is a trademark of Hercules Incorporated for thermoplastic hydroxypropyl cellulose. Thermoplastic hydroxypropyl cellulose and its manufacture are described in U.S. Pat. No. 3,278,521 to E. D. Klug, dated Oct. 11, 1966. Other suitable water-soluble thermoplastic substances which can be used to prepare the golf tee of this invention include polyvinyl alcohol, polyethylene oxide, methyl cellulose and hydroxypropylmethyl cellulose.

Any normally solid fertilizer which preferably can withstand the heat of injection molding can be used as the fertilizer component dispersed in the water-soluble thermoplastic material. However, it is particularly preferred to use a slow release nitrogenous fertilizer, such as ureaform.

Ureaform, as is well known, is the acid catalyzed polymeric condensate of urea and formaldehyde at a urea to formaldehyde mole ratio in a range from about 1:1 to about 2:1. This normally solid material comprises a water-soluble mostly crystalline low molecular weight fraction and a water-insoluble largely noncrystalline, glassy-like fraction. A preferred ureaform is one made from urea and formaldehyde having a mole ratio in the range from about 1.2:1 to about 1.5:1, most preferably about 1.4:1, and having these specifications:

| | |
|---|---|
| Water Insoluble Nitrogen (WIN) | 24–28% |
| Total Nitrogen | 38–39% |
| Activity Index (AI) | 40% |

["Urea formaldehyde Fertilizers", Kravlovic, R. D., and Morgan, W. A., *Agriculture and Food Chemistry*, Vol. 2, No. 2, pages 92–94 (1954); Association of Official Agricultural Chemists, "Official Methods of Analysis", 9th Ed. (1960) page 15.]

To inhibit degradation of hydroxypropyl cellulose a stabilizer can be added to the composition. Suitable stabilizers include butylated hydroxytoluene, dilauryl thiodipropionate, and the sodium, potassium and calcium salts of benzoic, propionic and sorbic acids.

To improve stiffness and rigidity of the golf tee, it is preferred to add a minor (compared to the water-soluble thermoplastic material) amount of a stiffening agent. The addition of this agent also improves the resistance of the tee to "fingerprint" when handled. Suitable stiffening agents include resins, such as polystyrene, low density polyethylene and butadienestyrene copolymers, and low molecular weight waxy material, such as polyethylene having a molecular weight of about 500 to about 2000. The resin is added in an amount up to 30% preferably from about 10% to about 20% by weight, based on the weight of the tee. The waxy material is added in an amount up to about 3% and is preferably about 0.1 to about 2% by weight, based on weight of the tee.

Other fillers, such as starch, talc, water-soluble nonthermoplastic cellulosics, wood flour, clays, silica, wood pulp, cotton linters, asbestos, calcium carbonate, calcium sulfate, pigments and diatomaceous earth can be included in the composition. The amount of filler added depends on the nature of the particular filler added. In a preferred embodiment, starch is added in an amount of 15 to about 25%, based on the weight of the total composition.

The components of the composition are dry blended by conventional methods and the resulting mixture is injection molded to form the golf tee. The temperature of the molding step is from about 130° to about 185° C. and preferably 155° to about 165° C.

Figure 2:
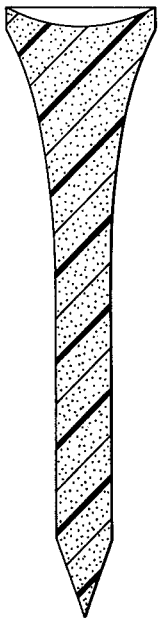

The best mode now contemplated of carrying out this invention is illustrated by the following example and in the drawing which forms a material part of these disclosures. In the drawing, FIG. 1 shows a perspective view of the golf tee of this invention and FIG. 2 shows a cross section of the golf tee along the line of 2—2 of FIG. 1. This invention is not limited to the specific embodiment illustrated in this example. All parts and percentages given in the example are by weight.

EXAMPLE

The following components are dry blended in a high intensity blender:

| Component | Parts |
|---|---|
| Hydroxypropyl cellulose (molecular weight = 140,000 – 160,000 and M.S. = 3.7 | 88.5 |
| Starch | 26.0 |
| Butylated hydroxytoluene | 0.25 |
| Dilauryl thiodipropionate | 0.25 |
| Ureaform | 3.75 |
| $TiO_2$ | 2.5 |
| Phthalocyanene Blue | 0.125 |
| Polyethylene wax | 2.5 |
| Polystyrene | 18.0 |

The resulting mixture is extruded to form molding pellets. The pellets are fed into injection molding equipment and molded at 160° C. into the shape of a golf tee. The golf tee has excellent impact resistance, is readily soluble in water and does not damage the blades of mowing equipment.

These and other advantages, features and specific embodiments of this invention will become readily apparent to those exercising oridinary skill in the art after reading the foregoing disclosures. In this connection, while specific embodiments of this invention have been described in considerable detail, variations and modifications of these embodiments can be effected without departing from the spirit and scope of the invention as disclosed and claimed.

The term "consisting essentially" as used in this specification excludes any unrecited substance at a concentration sufficient to substantially adversely affect the essential properties and characteristics of the composition of matter being defined, while permitting the presence of one or more unrecited substances at concentrations insufficient to substantially adversely affect said essential properties and characteristics.

I claim:

1. A golf tee consisting essentially of water-soluble thermoplastic hydroxypropyl cellulose having an M.S. of 2 to 10 and dispersed therein from about 1 to about 30% by weight, based on the weight of the golf tee, of a slow release nitrogenous fertilizer.

2. A golf tee of claim 1 wherein said slow release fertilizer is ureaform made from urea and formaldehyde having a mole ratio in a range from about 1.2:1 to about 1.5:1.

3. A golf tee of claim 1 wherein said composition also contains up to 20% by weight, based on the weight of the total composition, of polystyrene.

4. A golf tee of claim 3 wherein said composition also contains a filler.

5. A golf tee of claim 3 wherein said composition also contains from about 15 to about 25% by weight, based on the weight of the total composition, of starch.

* * * * *